US005100070A

United States Patent [19]

Montgomery, Sr.

[11] Patent Number: 5,100,070

[45] Date of Patent: Mar. 31, 1992

[54] INSERT TEETH FOR A MATERIAL BREAKER MACHINE

[75] Inventor: Robert C. Montgomery, Sr., Jacksonville, Fla.

[73] Assignee: Montgomery Industries International Inc., Jacksonville, Fla.

[21] Appl. No.: 542,060

[22] Filed: Jun. 22, 1990

[51] Int. Cl.[5] ..... B02C 18/18

[52] U.S. Cl. ..... 241/294; 144/230

[58] Field of Search ..... 241/189 R, 191, 195, 241/293, 294, 243, 242; 144/174, 230; 407/46, 51

[56] References Cited

U.S. PATENT DOCUMENTS

| | | | |
|---|---|---|---|
| 133,111 | 11/1872 | Mitchell | 241/191 |
| 2,874,912 | 2/1959 | Sennsholtz et al. | 241/294 X |
| 4,162,770 | 7/1979 | Lewis | 241/294 X |
| 4,826,090 | 5/1989 | Orphall | 241/294 X |

FOREIGN PATENT DOCUMENTS

| | | | |
|---|---|---|---|
| 956188 | 1/1957 | Fed. Rep. of Germany | 241/191 |
| 2226245 | 12/1973 | Fed. Rep. of Germany | 144/230 |
| 1258089 | 11/1986 | Japan | 241/294 |

*Primary Examiner*—Mark Rosenbaum
*Attorney, Agent, or Firm*—Nies, Kurz, Bergert & Tamburro

[57] ABSTRACT

Improved insert teeth and holder assemblies are provided for a material breaker machine intended for use in reducing chunks or pieces of wood, metal and other materials to small size. The present invention includes an insert tooth member having a pair of edges, either of which may serve as a cutting edge. An insert tooth holder is provided for mounting of the insert tooth. The insert tooth and insert holder interengage through a raised portion on the one and a recessed portion on the other which mate to form a positive mechanical lock. The insert tooth is reversibly mounted on the insert holder to allow either of the pair of edges to assume the position of the cutting edge. The location of the interengaged components allows them to be fully protected from the material being cut, thus minimizing wear and damage. In one embodiment, the insert tooth is inclined at an angle with respect to the insert holder, thus providing relief against back-up of material being processed and allowing the material to feed more quickly.

4 Claims, 3 Drawing Sheets

INSERT TEETH FOR A MATERIAL BREAKER MACHINE

BACKGROUND AND SUMMARY OF THE INVENTION

The present invention relates to the reduction and disposal of wood and other materials and more particularly to insert teeth which are employed in a material breaker machine.

The insert teeth of the present invention may be employed in a material breaker machine such as that described in U.S. Pat. No. 2,869,793 to Montgomery. Such apparatus is intended for use in reducing chunks or pieces of wood, bark, tires, metal and other materials to small size so that the reduced material may be conveyed by a moving stream of air or other means to a point of disposal.

Previous knife or tooth constructions for use in wood reducing machines and similar apparatus are described in the following U.S. Pat. Nos.: 4,047,670 to Svensson; 4,271,882 to Valo; 4,669,516 to Carpenter et al.; and 4,771,708 to Carpenter et al.

By the present invention, there are provided improved insert teeth and holder assemblies having features which provide a strong and durable construction which avoids twisting under impact load, while also being reversible so as to provide two separate wearing surfaces.

The insert teeth and holders employed in the present invention may be installed in rotors of the type described in U.S. Pat. No. 2,869,793 which is incorporated herein by reference.

Accordingly, it is an object of the present invention to provide an insert tooth assembly for a wood or other material breaker machine in which a raised portion and a recessed portion mate together and interengage to form a positive mechanical lock.

It is another object of the present invention to provide an insert tooth assembly having an insert tooth of a configuration which allows the tooth to interengage with the insert tooth holder so as to protect the tooth from wear or damage.

A further object of the present invention is to provide an insert tooth assembly in which the insert tooth is reversible.

Another object of the present invention is to provide an insert tooth construction which avoids twisting under impact loads which occur during operation of material breaker equipment.

A further object of the present invention is to provide an insert tooth and insert tooth holder of a construction which allows the holding mechanism to function effectively with the insert tooth installed on the front or either side or on the top or bottom of the insert tooth holder.

DESCRIPTION OF THE PREFERRED EMBODIMENTS

Figure 1:
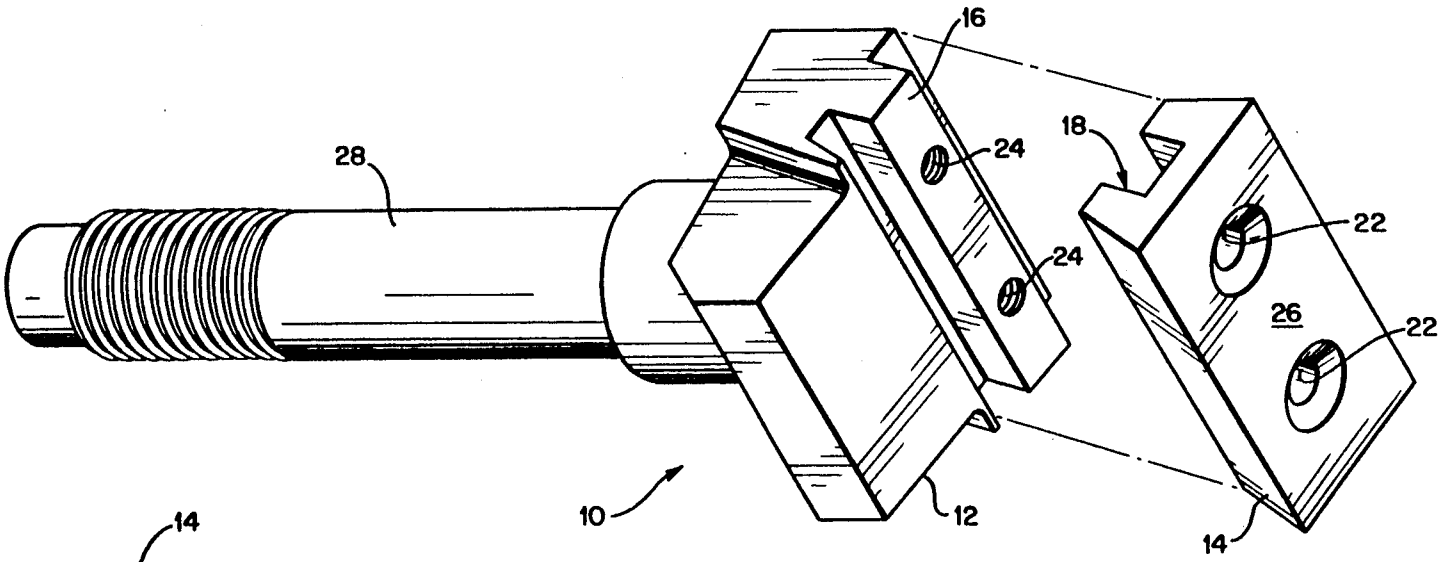
FIG. 1 is an isometric view of an insert tooth and insert holder constructed in accordance with the present invention.
Figure 2:
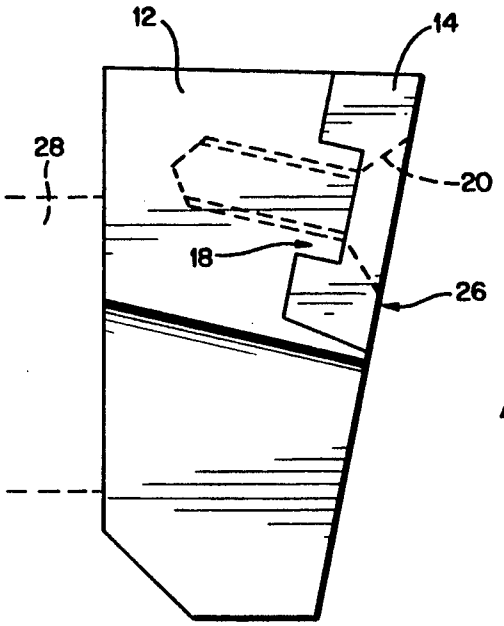
FIG. 2 is a side elevation of an insert tooth assembly which employs the insert tooth and insert holder of FIG. 1.

In the embodiment of the invention as shown in FIGS. 1 and 2, there is provided an insert tooth assembly 10 which includes an insert tooth holder 12 with attached shaft 28 and an insert tooth 14.

In this embodiment, the insert holder 12 is machined to provide a rib or tongue portion 16. The insert tooth 14 then has a matching slot or groove portion 18. This construction provides a "tongue-in-groove" configuration to keep the insert tooth 14 from twisting under impact load. It also protects that portion of the assembly 10 in which close contact between the two parts is essential from any form of wear to guarantee that proper contact will be provided between the two mating parts.

The insert tooth 14 is secured to the insert holder 12 by screws 20 passing through two pairs of holes 22 and 24 in the tooth 14 and holder 12 respectively. These holes 22 and 24 are preferably spaced so as to provide equal support adjacent each end portion of the tooth 14 and with the fasteners 20 having the head portions flush with the outer surface 26 of the tooth 14.

As shown in FIGS. 1 and 2, the axis of the insert tooth 14 is inclined at an angle relative to the longitudinal axis of the holder 12 and shaft 28. This angle, while not essential, is desirable as it provides relief against back-up of material being processed and thus allows the material to feed more quickly. Thus an angle of about 0 to 45 degrees may be employed, with the preferred angle being about 5 to 15 degrees.

One advantage of the present invention is that a "reversible" tooth with two separate wearing surfaces is now obtained. It is only necessary to remove the two fasteners 20 holding the insert tooth 14 to the mating holder 12, rotate the insert tooth 14 by 180 degrees, and bolt the two pieces back together to have a fresh wearing surface.

The present invention minimizes the amount of time required to maintain the hog and also reduces the net cost to the customer of an individual cutting surface since the cost of the insert tooth provides two cutting surfaces instead of one.

An additional advantage is that various types of tool steels can be used interchangeably to determine the most effective metallurgy for this particular application.

Similarly, a mild steel part could have hard rod applied to it and also be used with this approach.

The present invention reduces significantly the amount of freight on replacement parts when existing parts become worn through normal wear and tear and also eliminates the need for returning a part for rebuilding since the cost of this approach will be much less than the cost of attempting to rebuild the part.

The location of the interengaged "tongue-in-groove" components allows the mating components to be fully protected from the material being cut, thus avoiding wear or damage which could require replacement of the insert tooth.

Figure 3:
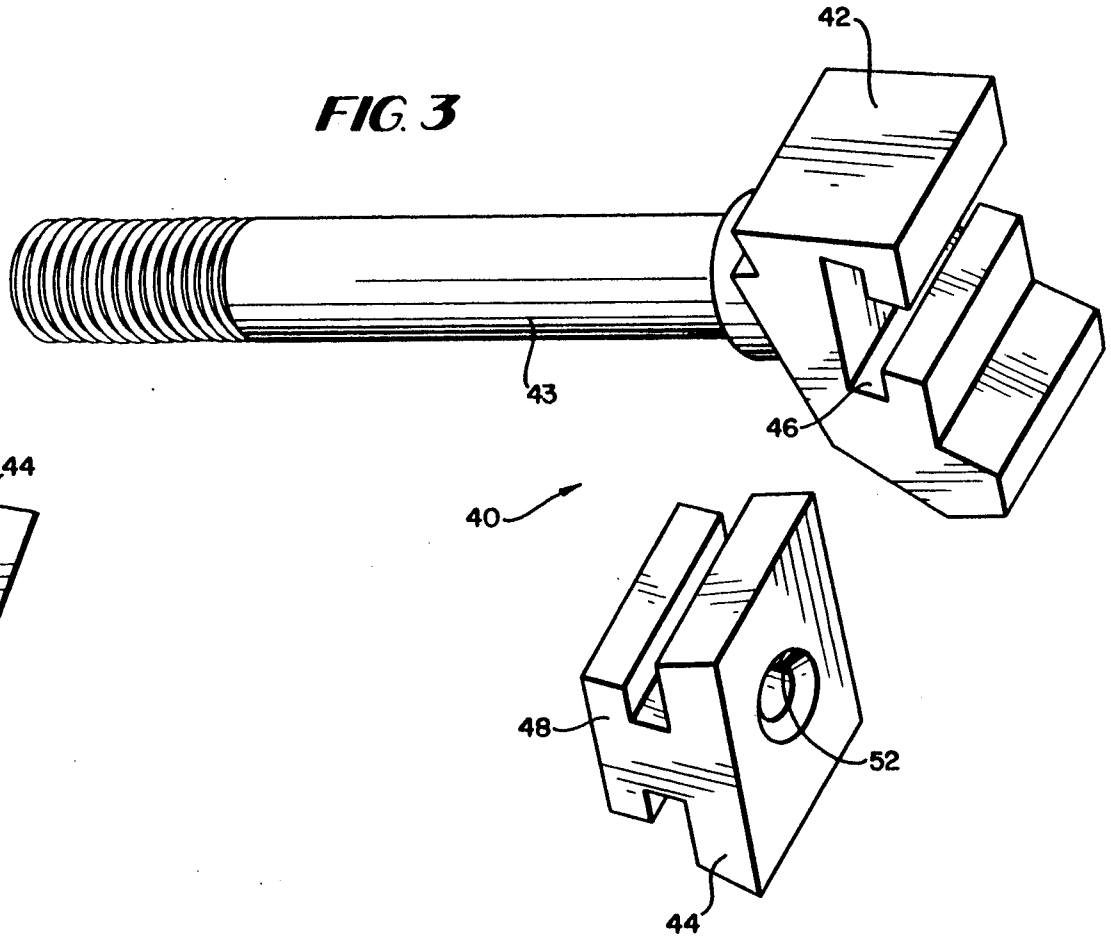
FIG. 3 is an isometric view of an alternative embodiment of an insert tooth and insert holder constructed in accordance with the present invention.
Figure 4:
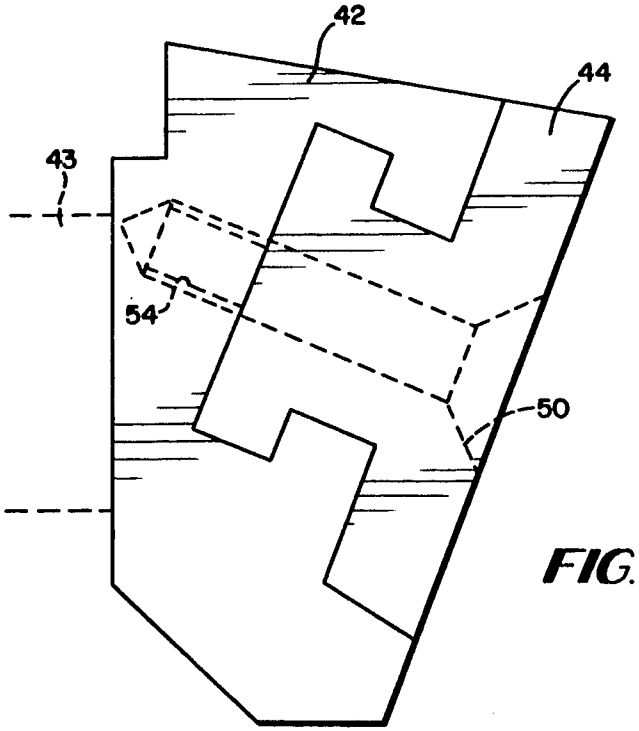
FIG. 4 is a side elevation of an insert tooth assembly which employs the insert tooth and insert holder of FIG. 3.

The embodiment of FIGS. 3 and 4 has similar functional advantages. The insert tooth assembly 40 of this embodiment includes an insert tooth holder 42 with attached shaft 43 and an insert tooth 44. In this embodiment, the insert holder 42 is machined throughout its length to provide a T-shaped slot 46. The insert tooth 44 then has a matching flange 48 of T-shaped cross section. The insert tooth 44 is secured to the insert holder 42 by a screw or bolt 50 passing through a hole 52 in the insert tooth 44 and a matching hole 54 in the insert holder 42. The main difference from the previous embodiment is that a slot 46 is cut through the part of the assembly that holds the insert tooth 44 to provide a positive mechanical lock. In this construction the function of the screw or bolt 50 is to assure a snug fit and to keep the part from shifting from side to side. However, if the bolt fails, the insert tooth 44 is prevented by the flange 48 from coming free from the holder 42.

As with the previous embodiment, the portion of the insert tooth 44 that requires a close contact with the holder is protected from wear. Again, the insert is reversible providing all the advantages outlined above.

The axis of the insert tooth 44 in the embodiment of FIGS. 3 and 4 is inclined at an angle of about 0 to 45 degrees relative to the longitudinal axis of the holder 42 and shaft 43 in a manner similar to the previous embodiment. The preferred angle is in the range of about 5 to 15 degrees.

Figure 5:
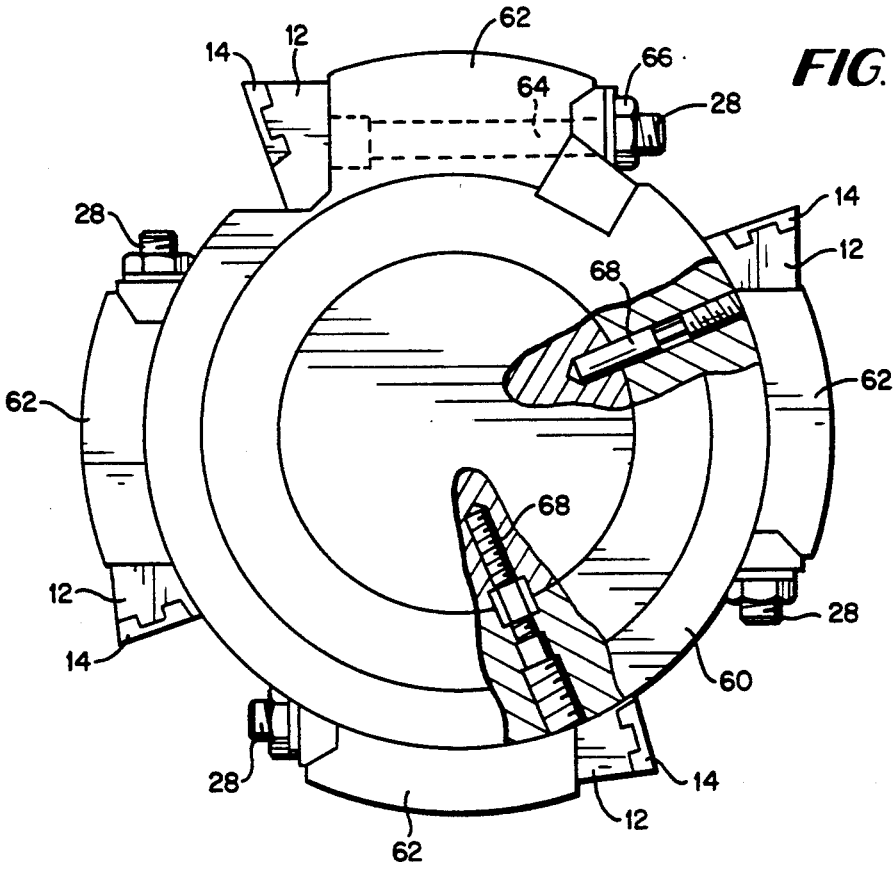
FIG. 5 is an elevation in partial cross section of a material breaker rotor having installed the insert tooth assembly of FIG. 1.

As shown in FIG. 5, the insert tooth assembly 10 may be installed in a rotor 60 having a series of tooth supports 62 projecting substantially radially, with each support 62 having a bore 64 therein extending transversely of the corresponding radius of the rotor 60 to receive a shaft 28 of an insert holder 12. A nut 66 is tightened on the threaded end portion of shaft 28 of the insert holder 12. Screw members 68 are employed to secure the ring units of the rotor 60 shown by way of example.

Figure 6:
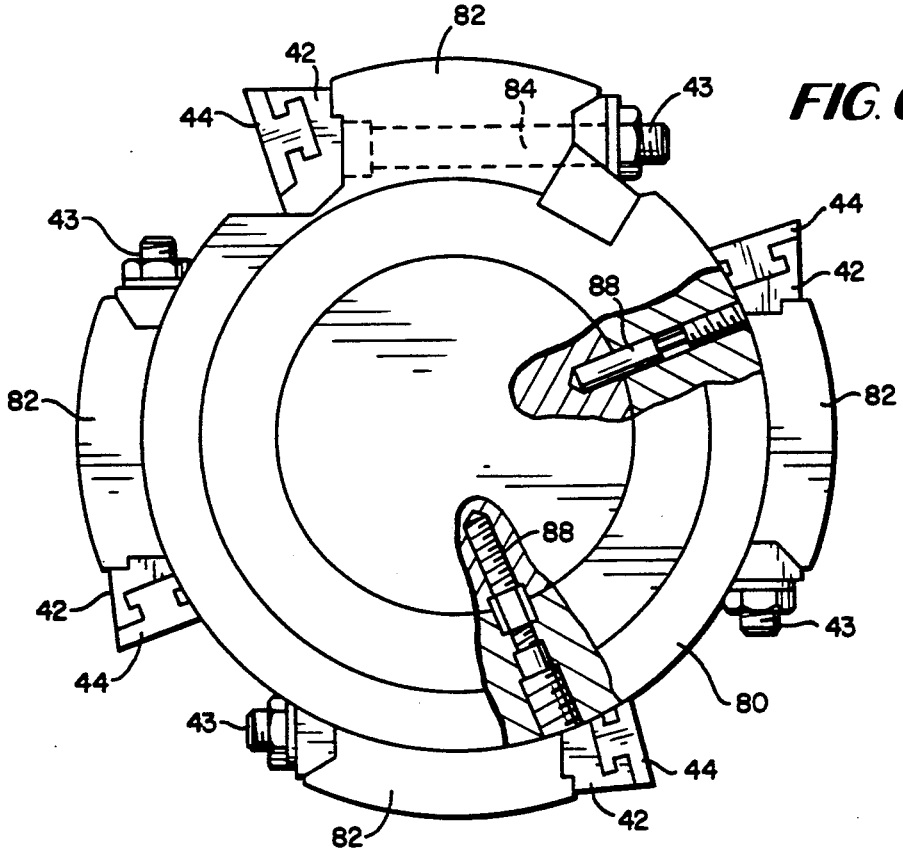
FIG. 6 is an elevation in partial cross section of a material breaker rotor having installed the insert tooth assembly of FIG. 3.

The insert tooth assembly 40 may be similarly installed in a rotor 80 having screw members 88, as shown in FIG. 6, with a series of tooth supports 82 projecting substantially radially, and with each support 82 having a transverse bore 84 for receiving a shaft 43 of an insert holder 42.

In an alternative embodiment to those shown in FIGS. 5 and 6, the insert holder without a shaft may be secured directly to the tooth support.

While the embodiments of FIGS. 1 through 4 are shown with the insert teeth installed on the front of the holders, it is within the scope of the invention for the insert tooth to be installed on either side or on the top or bottom of the insert tooth holder. It is also within the scope of the invention for the rib or tongue to be provided on the insert tooth of FIGS. 1 and 2 rather than on the insert holder, and with the matching slot or groove provided on the insert holder. Similarly, it is within the scope of the invention for the T-shaped slot to be provided on the insert tooth of FIGS. 3 and 4 and with the flange of T-shaped cross section provided on the insert holder.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An insert tooth assembly which provides a reversibly mounted insert tooth in a durable construction for a material breaker machine, comprising:

an elongated insert tooth holder having a front face with a recess, said front face extending at an angle to the longitudinal axis of said tooth holder;

an insert tooth member having a pair of edges, either of which may serve as a cutting edge, each of said pair of edges being formed by two intersecting insert tooth faces including one face which is common to both of said pair of edges, said insert tooth member being positioned in said recess;

said insert tooth and insert tooth holder having interengaging parts including at least one face extending parallel and at least one face extending perpendicular to said front face of the tooth holder, said interengaging parts being symmetrically positioned about a central insert tooth axis, thus allowing said insert tooth cutting edges to be reversed when said insert tooth is rotated 180 degrees about said central axis, and with one face of the edge which is not in use as the cutting edge being positioned in said recess so as to provide a curable construction, wherein a portion of said angled front face of the tooth holder is coplanar with said common face of the insert tooth member and wherein the other intersecting insert tooth face which forms the cutting edge with said common face is coplanar with another face of said tooth holder; and means for securing said insert tooth on said tooth holder.

2. The insert tooth assembly of claim 1 wherein said insert tooth and insert tooth holder are mutually engaged by an interlocking tongue and groove arrangement in which a tongue member in one of said insert tooth or tooth holder and having an outermost face parallel to said front face of the tooth holder engages a groove in the other of said insert tooth or tooth holder, said groove having side walls which are substantially perpendicular to said front face of the tooth holder.

3. The insert tooth assembly of claim 1 wherein said insert tooth and insert tooth holder are mutually engaged by an interlocking T-shaped flange and slot arrangement in which a T-shaped flange in one of said insert tooth or tooth holder and having an innermost face parallel to said front face of the tooth holder engages a T-shaped slot in the other of said insert tooth or tooth holder, said T-shaped slot having side walls which are substantially perpendicular to said front face of the tooth holder.

4. The insert tooth assembly of claim 1 wherein said angle is about 5 to 15 degrees.

* * * * *

UNITED STATES PATENT AND TRADEMARK OFFICE

CERTIFICATE OF CORRECTION

PATENT NO. : 5,100,070

DATED : March 31, 1992

INVENTOR(S) : Robert C. Montgomery, Sr.

It is certified that error appears in the above-identified patent and that said Letters Patent is hereby corrected as shown below:

Column 4, line 34,"curable" should read --durable--.

Signed and Sealed this

Twenty-eighth Day of September, 1993

Bruce Lehman

*Attest:*

BRUCE LEHMAN

*Attesting Officer*

*Commissioner of Patents and Trademarks*